US006796374B2

(12) United States Patent
Rong

(10) Patent No.: US 6,796,374 B2
(45) Date of Patent: Sep. 28, 2004

(54) HEAT EXCHANGER INLET TUBE WITH FLOW DISTRIBUTING TURBULIZER

(75) Inventor: Xiaoyang Rong, Toronto (CA)

(73) Assignee: Dana Canada Corporation, Oakville (CA)

( * ) Notice: Subject to any disclaimer, the term of this patent is extended or adjusted under 35 U.S.C. 154(b) by 0 days.

(21) Appl. No.: 10/410,065

(22) Filed: Apr. 9, 2003

(65) Prior Publication Data

US 2003/0192677 A1 Oct. 16, 2003

(30) Foreign Application Priority Data

Apr. 10, 2002 (CA) ..... 2381214

(51) Int. Cl.[7] ..... F28F 3/08
(52) U.S. Cl. ..... 165/109.1; 165/153; 165/174
(58) Field of Search ..... 165/109.1, 153, 165/174, 176

(56) References Cited

U.S. PATENT DOCUMENTS

| | | | | |
|---|---|---|---|---|
| 2,021,117 | A | | 11/1935 | Lucke |
| 2,615,686 | A | | 10/1952 | Davidson |
| 2,896,426 | A | | 7/1959 | Ayling |
| 3,111,168 | A | | 11/1963 | Huet |
| 3,976,128 | A | | 8/1976 | Patel et al. |
| 4,053,141 | A | | 10/1977 | Gussefeld |
| 4,274,482 | A | | 6/1981 | Sonoda |
| 4,524,823 | A | | 6/1985 | Hummel et al. |
| 4,545,428 | A | | 10/1985 | Onishi et al. |
| 4,926,933 | A | | 5/1990 | Gray |
| 4,936,381 | A | | 6/1990 | Alley |
| 4,945,635 | A | | 8/1990 | Nobusue et al. |
| 5,025,855 | A | | 6/1991 | Hoshino et al. |
| 5,129,333 | A | | 7/1992 | Frederick et al. |
| 5,630,473 | A | | 5/1997 | Nishishita |
| 5,651,268 | A | * | 7/1997 | Aikawa et al. ..... 62/525 |
| 5,875,834 | A | | 3/1999 | Brooks |
| 6,102,561 | A | | 8/2000 | King |
| 6,129,144 | A | * | 10/2000 | Bousquet ..... 165/153 |
| 6,179,051 | B1 | * | 1/2001 | Ayub ..... 165/167 |
| 6,199,401 | B1 | * | 3/2001 | Haussmann ..... 62/525 |
| 6,241,011 | B1 | | 6/2001 | Nakamura et al. |
| 6,318,455 | B1 | | 11/2001 | Nakado et al. |
| 2002/0046827 | A1 | * | 4/2002 | Saito et al. ..... 165/153 |

FOREIGN PATENT DOCUMENTS

| | | |
|---|---|---|
| DE | 1 679 334 | 3/1971 |
| EP | 0 563 474 | 10/1993 |
| EP | 0 709 640 | 5/1996 |
| EP | 0 727 625 | 8/1996 |
| EP | 0 843 143 | 5/1998 |
| EP | 0 905 467 | 3/1999 |
| JP | 03-247933 | 11/1991 |

* cited by examiner

*Primary Examiner*—Allen J Flanigan
(74) *Attorney, Agent, or Firm*—Ridout & Maybee LLP

(57) ABSTRACT

A turbulizer, such as a helical fin about a core pipe, is located in a heat exchanger manifold to distribute liquid phase fluid through a plurality of tube members connected to the manifold.

23 Claims, 8 Drawing Sheets

HEAT EXCHANGER INLET TUBE WITH FLOW DISTRIBUTING TURBULIZER

This application claims priority to Canadian Patent Application No. 2,381,214 filed Apr. 10, 2002.

BACKGROUND OF THE INVENTION

This invention relates to heat exchangers, and in particular, to heat exchangers involving gas/liquid, two-phase flow, such as in evaporators or condensers.

In heat exchangers involving two-phase, gas/liquid fluids, flow distribution inside the heat exchanger is a major problem. When the two-phase flow passes through multiple channels which are all connected to common inlet and outlet manifolds, the gas and liquid have a tendency to flow through different channels at different rates due to the differential momentum and the changes in flow direction inside the heat exchanger. This causes uneven flow distribution for both the gas and the liquid, and this in turn directly affects the heat transfer performance, especially in the area close to the outlet where the liquid mass proportion is usually quite low. Any maldistribution of the liquid results in dry-out zones or hot zones. Also, if the liquid-rich areas or channels cannot evaporate all of the liquid, some of the liquid can exit from the heat exchanger. This often has deleterious effects on the system in which the heat exchanger is used. For example, in a refrigerant evaporator system, liquid exiting from the evaporator causes the flow control or expansion valve to close reducing the refrigerant mass flow. This reduces the total heat transfer of the evaporator.

In conventional designs for evaporators and condensers, the two-phase flow enters the inlet manifold in a direction usually perpendicular to the main heat transfer channels. Because the gas has much lower momentum, it is easier for it to change direction and pass through the first few channels, but the liquid tends to keep travelling to the end of the manifold due to its higher momentum. As a result, the last few channels usually have much higher liquid flow rates and lower gas flow rates than the first one. Several methods have been tried in the past to even out the flow distribution in evaporators. One of these is the use of an apertured inlet manifold as shown in U.S. Pat. No. 3,976,128 issued to Patel et al. Another approach is to divide the evaporator up into zones or smaller groupings of the flow channels connected together in series, such as is shown in U.S. Pat. No. 4,274,482 issued to Noriaki Sonoda. While these approaches tend to help a bit, the flow distribution is still not ideal and inefficient hot zones still result.

SUMMARY OF THE INVENTION

In the present invention, a flow augmentation device that includes a turbulizing structure about a core pipe is located in a heat exchanger manifold to distribute liquid phase fluid through a plurality of tube members connected to the manifold. The turbulizer structure includes a helical fin in one preferred embodiment.

According to the present invention, there is provided a heat exchanger that includes a manifold defining an inlet manifold chamber having a manifold chamber inlet opening, a plurality of tube members each defining an internal flow channel having an opening into the manifold chamber, and an elongate core pipe fixed in the manifold chamber, the core pipe having a turbulizing structure extending along a portion thereof passing adjacent the flow channel openings for distributing liquid phase fluid flowing into the manifold chamber among the flow channels. Preferably, the turbulizing structure includes a helical fin, however in some applications different turbulizing structures could be used, such as spaced apart annular rings projecting from an outer surface of the core pipe or annular groves formed on an outer surface of the core pipe.

BRIEF DESCRIPTION OF THE DRAWINGS

Preferred embodiments of the invention will now be described, by way of example, with reference to the accompanying drawings in which.

DESCRIPTION OF THE PREFERRED EMBODIMENT

Figure 1:
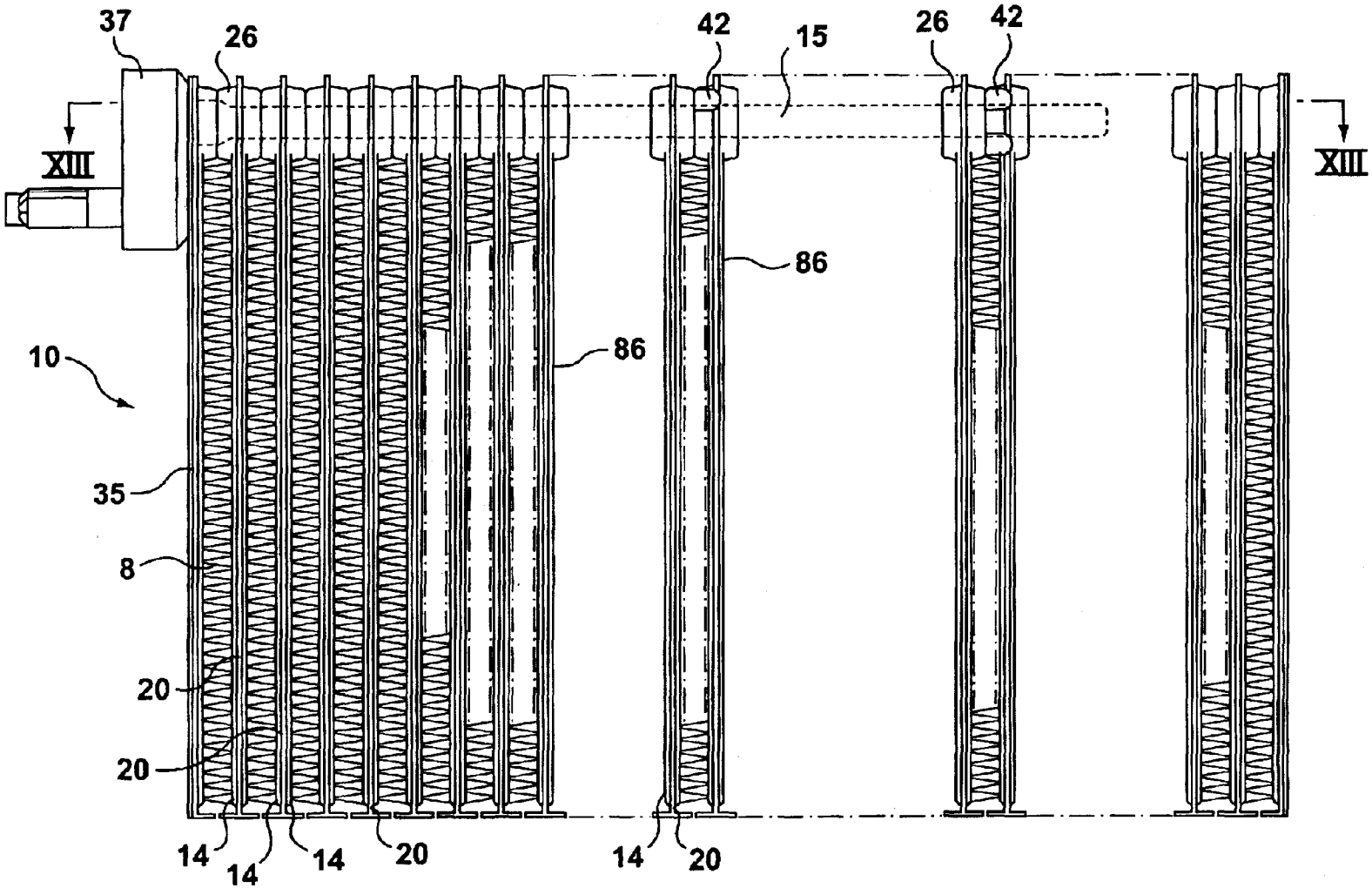
FIG. 1 is a side elevational view of a preferred embodiment of a heat exchanger according to the present invention.
Figure 2:
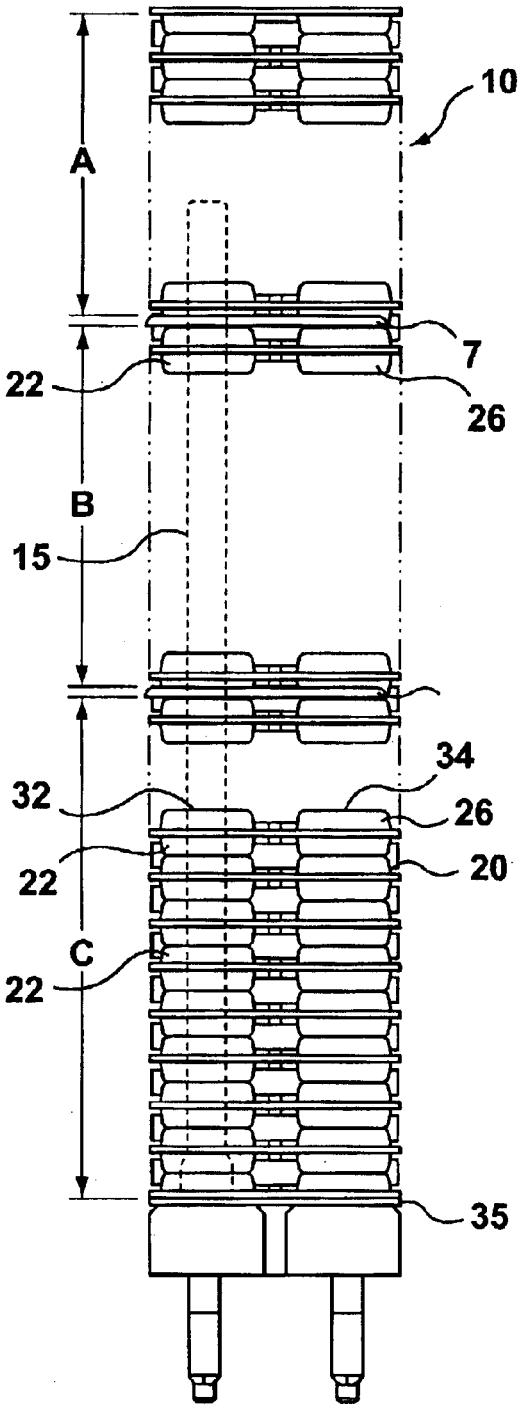
FIG. 2 is a top plan view of the heat exchanger shown in FIG. 1.
Figure 3:
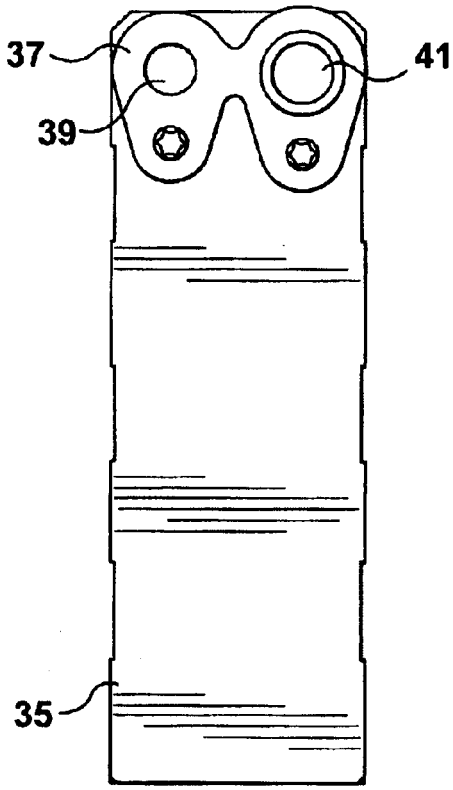
FIG. 3 is an end view of the heat exchanger, taken from the left of FIG. 1.
Figure 5:
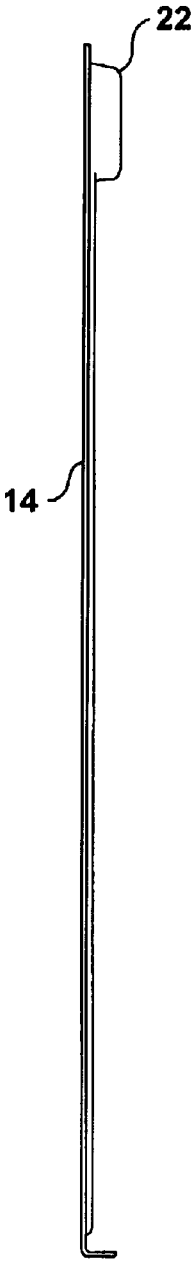
FIG. 5 is a side view of the plate shown in FIG. 4.
Figure 4:
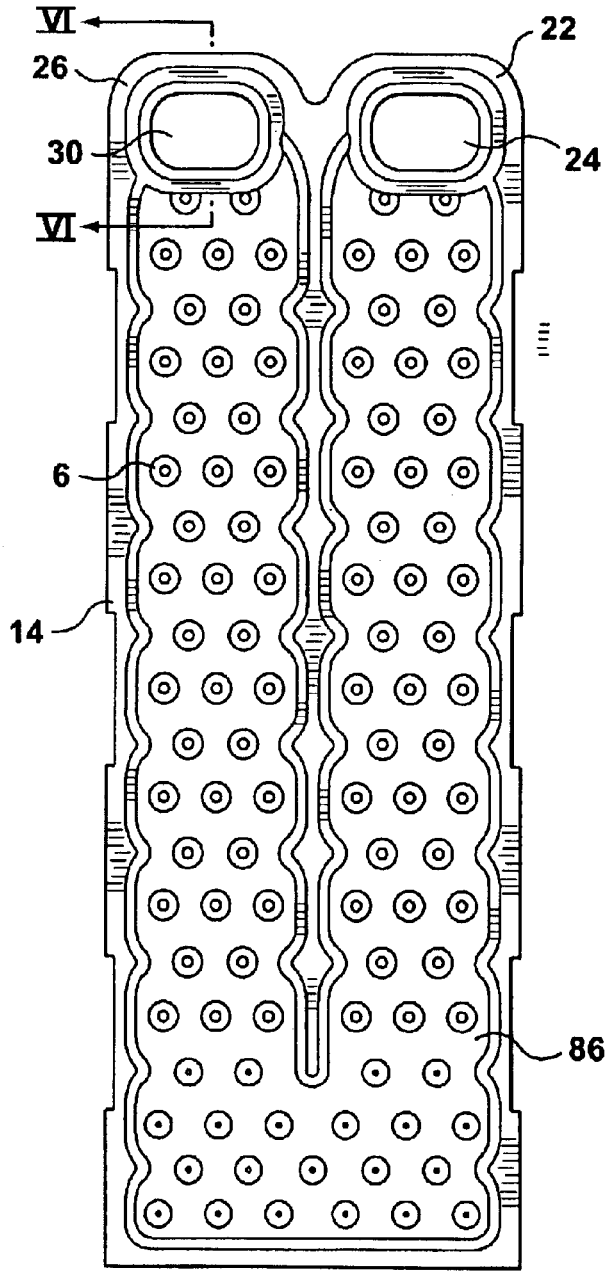
FIG. 4 is an elevational view of one of the main core plates used to make the heat exchanger of FIG. 1.
Figure 6:
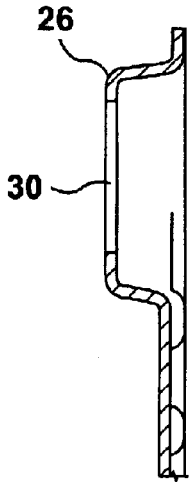
FIG. 6 is an enlarged sectional view taken along the lines VI—VI of FIG. 4.
Figure 9:
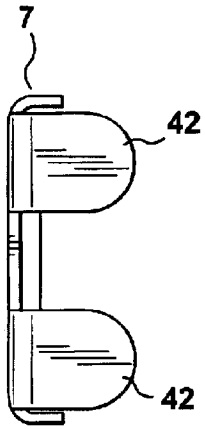
FIG. 9 is an end view of the barrier plate, taken from the right of FIG. 7.
Figure 7:
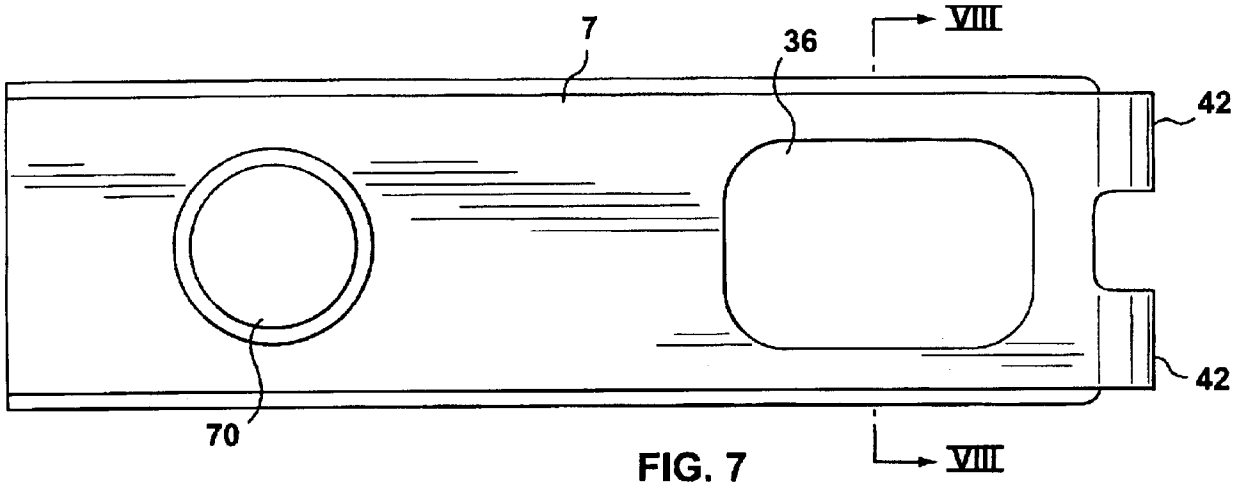
FIG. 7 is an elevational view of one type of barrier or partition shim plate used in the heat exchanger of FIG. 1.
Figure 10:
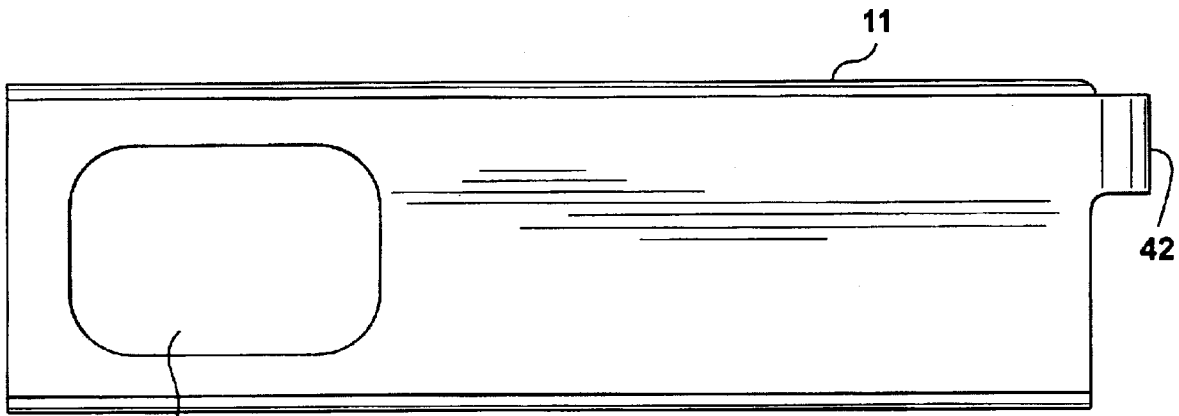
FIG. 10 is an elevational view of another type of barrier or partition shim plate of the heat exchanger of FIG. 1.
Figure 8:
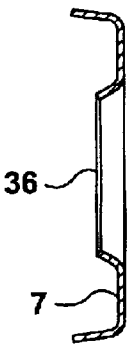
FIG. 8 is an enlarged sectional view taken along lines VIII—VIII of FIG. 7.

Referring firstly to FIGS. 1 to 6, a preferred embodiment of the present invention is made up of a stack of plate pairs 20 formed of back-to-back plates 14 of the type shown in FIGS. 4 to 6. Each plate pair 20 is a tube-like member defining a U-shaped flow channel 86 between its plates 14. Each plate pair 20 has enlarged distal end portions or bosses 22, 26 with first 24 and second 30 openings provided through the bosses in communication with opposite ends of the U-shaped flow channel. Each plate 14 may include a plurality of uniformly spaced dimples 6 (or other flow augmenting means such as turbulizer inserts or short ribs, for example) projecting into the flow channel created by each plate pair 20. Preferably, corrugated fins 8 are located between adjacent plate pairs. The bosses 22 on one side of the plates 14 are joined together to form a first manifold 32 and the bosses 26 on the other side of the plates 14 are joined together to form a second manifold 34. As best seen in FIG. 2, a longitudinal inlet tube 15 passes into the first manifold openings 24 in the plates to deliver the incoming fluid, such as a two-phase, gas/liquid mixture of refrigerant, to the right hand section of the heat exchanger 10. As will be explained in greater detail below, a spiral turbulizer is provided along a portion of the longitudinal tube 15 to direct fluid flow in a portion of the manifold 32. FIG. 3 shows end plate 35 with an end fitting 37 having openings 39, 41 in communication with the first manifold 32 and the second manifold 34, respectively.

The heat exchanger 10 is divided into plate pair sections A, B and C by placing barrier or partition plates 7 and 11, such as are shown in FIGS. 7 to 10, between the bosses 22, 26 of selected plate pairs in the heat exchanger, thus configuring the heat exchanger as a multi-pass exchanger. As seen with reference to diagrammatic FIGS. 11 and 12 and the sectional view of FIG. 13, the partition plates 7 and 11 divide the first and second manifolds 32 and 34 into manifold chambers 32A, 32B, 32C and 34A, 34B and 34C. The inlet tube 15 passes through manifold chamber 32C, an opening 38 through partition plate 11, through manifold chamber 32B, and through an opening 70 into the manifold chamber 32A, which an open end of the inlet tube 15 is in flow communication with. The opening 38 through partition plate 11 is larger than the outer diameter of the inlet tube 15 with the result that adjacent manifold chambers 32B and 32C are in direct flow communication with each other. The circumference about the opening 70 through partition plate 70, however, is tightly and sealably fitted to the outer diameter of the inlet tube 15 such that the adjacent manifold chambers 32A and 32B are not in direct flow communication with each other. The positioning of inlet tube 15 to pass through manifold chambers 32B and 32C permits the heat exchanger inlet and outlet openings 39, 41 to be at the same end of the heat exchanger 10.

The partition plate 11 is solid between adjacent manifold chambers 34B and 34C preventing direct flow communication therebetween. An opening 36 is provided through partition plate 7 so that adjacent manifold chambers 34A and 34B are in direct flow communication with each other. As shown in FIGS. 7 to 10, each partition plate 7, 11 may have an end flange or flanges 42 positioned such that the barrier plates can be visually distinguished from one another when positioned in the heat exchanger. For example, partition plate 7 has two end flanges 42 and partition plate 11 has an upper positioned end flange 42. In an alternative embodiment, partition plates 7 and 11 could be integrated into the boss portions 22, 26 of selected plates 14 so that separate partition plates 7 and 11 were not required. For example, a manifold partition could be formed by not stamping out opening 24 in the plates of a selected plate pair 20.

A novel feature of the heat exchanger 10 is the inclusion of a spiral turbulizer 80 in the manifold chamber 32C that is provided by a helical fin 82 that extends along a length of the inlet pipe 15 passing longitudinally through, and spaced apart from the walls of, the manifold chamber 32C. As will be explained in greater detail below, the spiral turbulizer 80 distributes fluid flow, and in particular liquid-phase fluid flow, among the plurality of tube members having flow channels that are in communication with the manifold chamber 32C.

Figure 11:
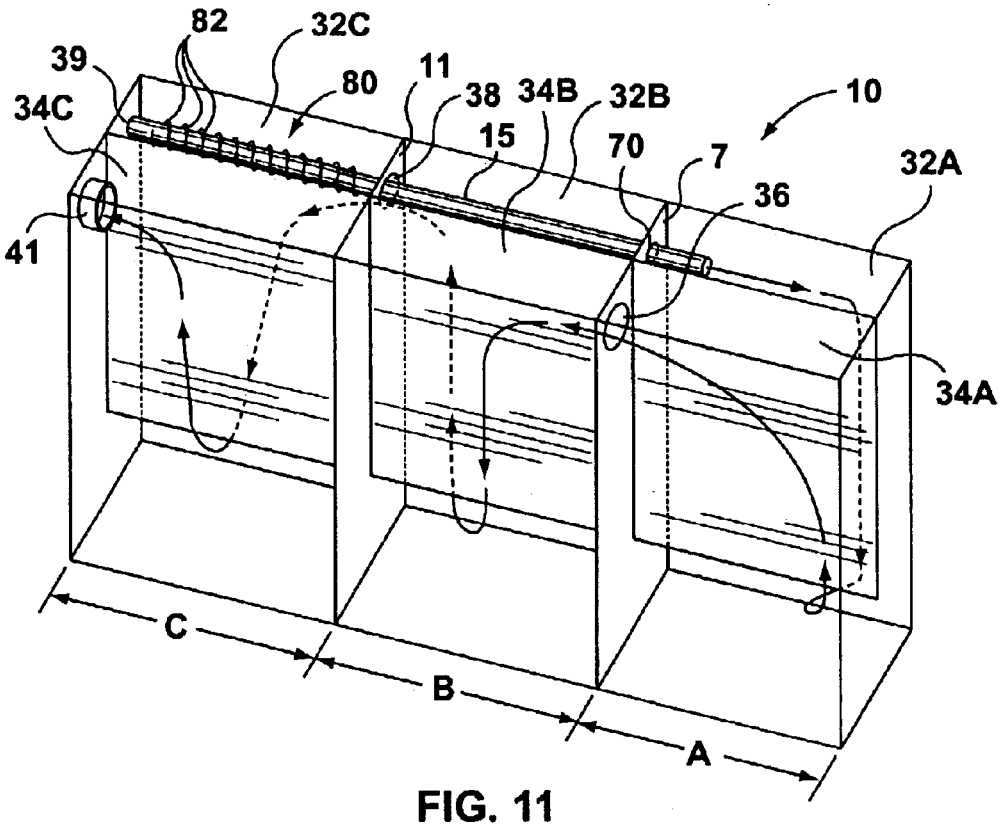
FIGS. 11 and 12 are each perspective diagrammatic views, taken from opposite sides, showing a flow path inside of the heat exchanger 10.
Figure 12:
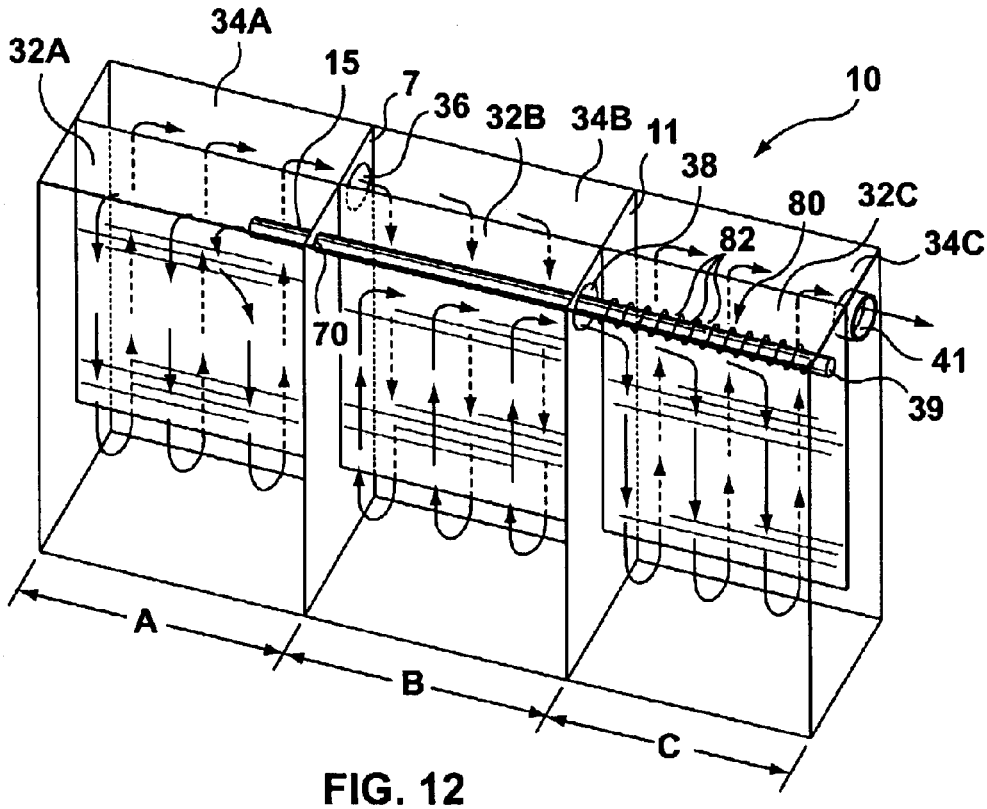
Figure 13:
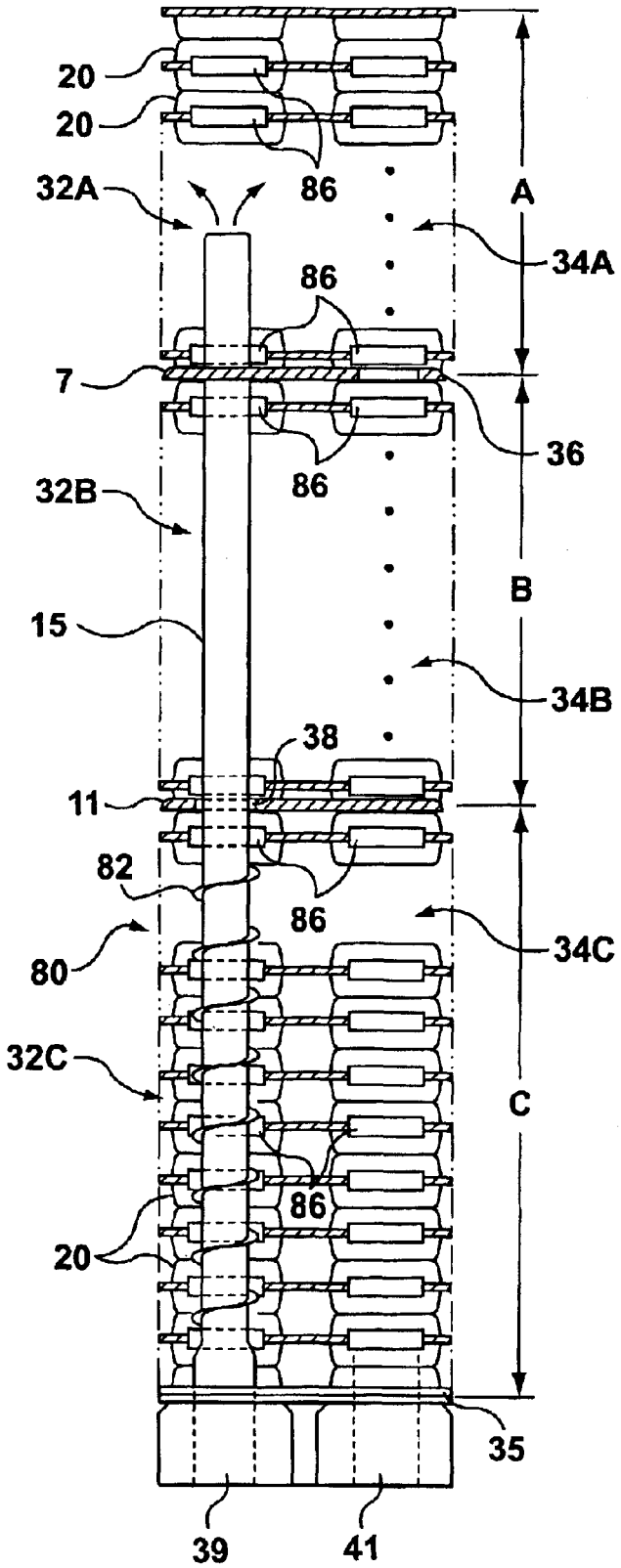
FIG. 13 is a sectional view taken along the lines XIII—XIII of FIG. 1.

As indicated by flow direction arrows in FIGS. 11, 12 and 13, during use of the heat exchanger 10 as an evaporator, the fluid to be evaporated enters heat exchanger inlet opening 39 and flows through the inlet tube 15 into the manifold chamber 32A of section A of the heat exchanger. The fluid, which in manifold chamber 32A will typically be two-phase and primarily in the liquid phase, enters the flow channels 86 defined by the stack of parallel plate pairs 20 that make up section A, travels in parallel around the U-shaped flow channels 86 and into manifold chamber 34A, thus completing a first pass. The fluid then passes through the opening 36 in barrier plate 7 and into the manifold chamber 34B of heat exchanger section B, and travels through the U-shaped flow channels 86 of the plate pairs that make up section B to enter the manifold chamber 32A, thus completing a second pass.

After two passes through the heat exchanger, the gas phase component of the fluid will generally have increased significantly relative to the liquid phase, however some liquid phase will often still be present. The two phase fluid passes from chamber manifold chamber 32B to manifold chamber 32A through the passage that is defined between the outer wall of the inlet tube 15 and the circumference of opening 38, such passage functioning as a chamber inlet opening for chamber 32C. The portion of the inlet tube 15 passing through the opening 38 is preferably centrally located in opening 38 so that the entire outer wall circumference is spaced apart from the circumference of opening 39. Thus, the two phase fluid entering the chamber 32C will generally be distributed around an outer surface of the inlet tube 15 and traveling in a direction that is substantially parallel to the longitudinal axis of the tube 15. The helical fin 82 provided on the tube 15 augments the flow of the fluid in the manifold chamber 32C to assist in distributing the fluid, and in particular the liquid-phase component of the fluid, among the flow channels 86 of the plate pairs 20 that are in communication with the manifold chamber 32C. After passing through the flow channels 86 of the plate pairs 20 of section C, the fluid enters manifold chamber 34C and subsequently exits the heat exchanger 10 through outlet opening 41.

In the absence of the helical fin 82, the liquid (which has higher momentum than the gas) would tend to shoot straight across the manifold chamber 32C along the outer surface of the inlet tube 15, missing the first flow channels in section C, so that the liquid phase component would be disproportionately concentrated in the last few plate pairs 20 in section C (i.e. those plate pairs located closest to end plate 35), resulting in the last few flow channels having much higher liquid flow rates and lower gas flow rates than the first channels in section C. Such an uneven concentration can adversely affect heat transfer efficiency and result in an undesirable amount of liquid exiting the heat exchanger, causing the flow control or expansion valve of the cooling system to which the heat exchanger is connected to engage in "hunting" (i.e. continuous valve opening and closing due to intermittent liquid presence, resulting in reduced refrigerant mass flow). The helical fin 82 of spiral turbulizer 80 breaks up the liquid flow to more evenly distribute the liquid flow in parallel throughout the flow channels of final pass section C. More proportional distribution results in improved heat transfer performance and assists in reducing liquid phase fluid leaving the heat exchanger, thereby reducing expansion valve "hunting".

The spiral turbulizer 80 can be economically incorporated in mass produced heat exchangers and has a configuration that can be consistently reproduced in the manufacturing environment and which is relatively resistant to the adverse affects of heat exchanger operating conditions.

Figure 14A:
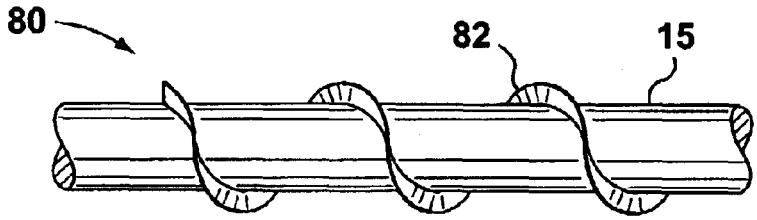
FIGS. 14A–14E are side scrap views showing different configurations of a spiral turbulizer of the heat exchanger of FIG. 1.
Figure 14B:
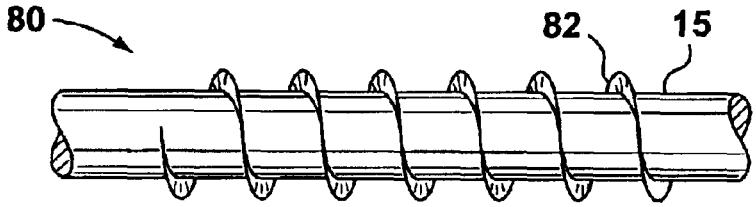
Figure 14C:
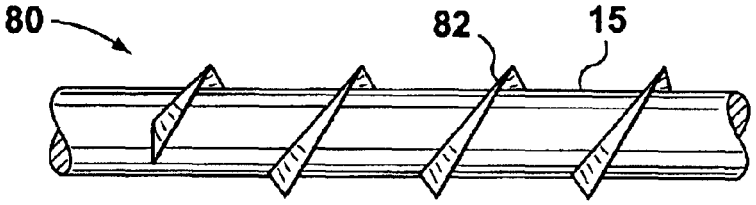
Figure 14D:
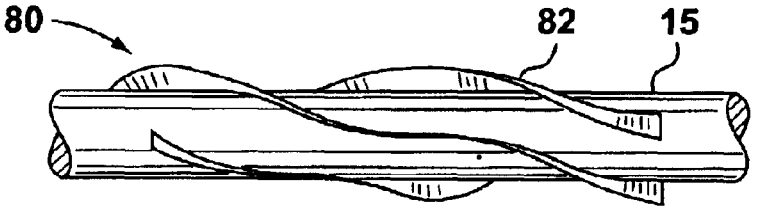
Figure 14E:
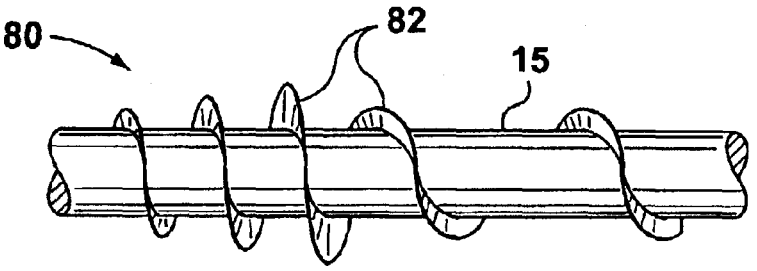

The fin pitch and fin height can be selected as best suited to control liquid flow distribution for a particular heat exchanger configuration and application. Various types of fin configurations for spiral turbulizer 80 are shown in FIGS. 14A to 14E. FIG. 14B shows a spiral turbulizer having a relatively steep pitch and tight spacing between adjacent fin revolutions, the fin 62 extending substantially transverse to the flow direction of incoming liquid in chamber 32C. FIG. 14A shows a spiral turbulizer having a shallower pitch and greater inter-revolution spacing. Although only five configurations are shown in FIGS. 14A–14E, it is contemplated that other configurations could be used. In some configurations, the helical fin may have non-circular outer edges (such as squared outer edges as shown in FIG. 14C for example), or may have a number of helical fins that run parallel to each other (FIG. 14D for example). In some embodiments, the helical fin pitch, spiral spacing between longitudinally adjacent fin portions, angle and size (i.e. height) or combinations of one or more thereof could vary along the length of the tube 15, as shown in the notional spiral turbulizer of FIG. 14E. In some embodiments, there may be breaks in the helical fin along the length of tube 15 (not shown).

In the illustrated embodiment, the spiral turbulizer is selectively located in the intake manifold chamber 32C of the final pass of a multi-pass heat exchanger. It is contemplated that in some applications, spiral turbulizers may be located in the intake manifold chamber of another pass other than or in addition to the final pass. In some applications, the spiral turbulizer may be used in a single pass heat exchanger, or in a multi-pass heat exchanger having more or less than the three passes of the exemplary heat exchanger shown in the drawings and described above. The spiral turbulizer could be used in heat exchanges having flow channels that are not U-shaped, for example straight channels, and is not limited to heat exchangers in which the tube members are formed from plate pairs.

In the illustrated preferred embodiment, the helical fin is mounted on the inlet tube 15 and the same fluid passes both through the inside of the inlet tube and then subsequently outside of the inlet tube 15. In some applications, a core pipe other than the inlet tube 15 could be used as the core for the helical fin (for example, in an embodiment where inlet tube 15 was replaced by a direct external opening into manifold chamber 32A).

Figure 15:
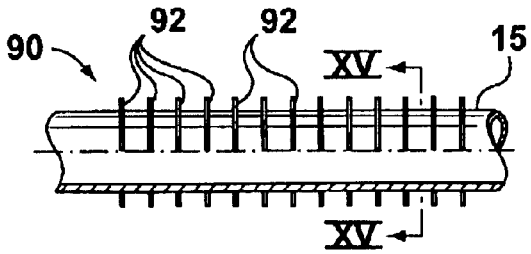
FIG. 15 is a side, partial sectional, scrap view of a further configuration of a turbulizer of the heat exchanger of FIG. 1
Figure 15A:
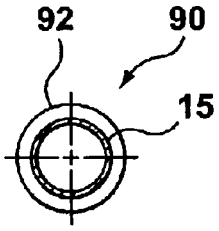
FIG. 15A is a sectional view taken along the lines XV—XV of FIG. 15.
Figure 16:
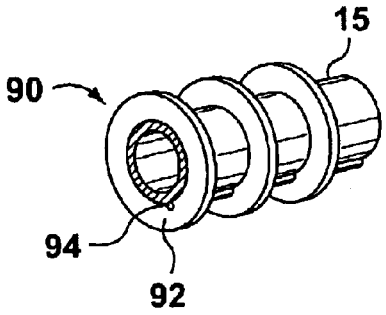
FIG. 16 is a perspective view of the turbulizer of FIG. 15.
Figure 17:
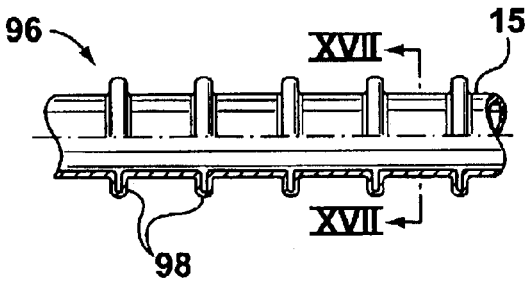
FIG. 17 is a side, partial sectional, scrap view of a further configuration of a turbulizer of the heat exchanger of FIG. 1
Figure 17A:
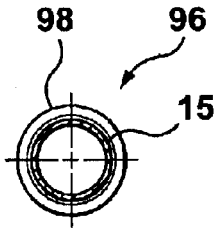
FIG. 17A is a sectional view taken along the lines XVII—XVII of FIG. 17.

A spiral turbulizer having a helical fin has heretofore been described as the preferred embodiment of an intake tube mounted turbulizer as such configuration is relatively easy to manufacture in large quantities by helically wrapping and securing a wire or other member about the portion of the intake tube 15 that will be located in manifold chamber 32C. However, in some embodiments, other flow augmenting structures could be provided along the intake tube 15 to distribute liquid phase fluid coming through opening 38 among the plate pairs 20 of manifold chamber 32C. By way of example, FIGS. 15 and 15A show a further possible turbulizer 90 for use in manifold chamber 32C, having a series of radially extending annular rings 92 about the intake tube 15 to break up and distribute liquid phase fluid flow, instead of a helical fin. As illustrated in FIG. 16, a longitudinal rib 94 could be provided along the intake tube 15 to be received in a corresponding groove provided in each of the rings 92 to assist in positioning the rings on tube 15. Alternatively, a longitudinal grove could be provided along the intake tube 15 for receiving a burr provided in an inner surface of each ring 92. FIGS. 17 and 17A show a further possible turbulizer 96 which is similar to turbulizer 90 in that it includes a series of radially extending rings 98 along the length of inlet tube 15. However, the rings 98 and tube 15 are of unitary construction, the rings 98 being formed by periodically compressing sections of the tube 15 at intervals along its length.

Figure 18:
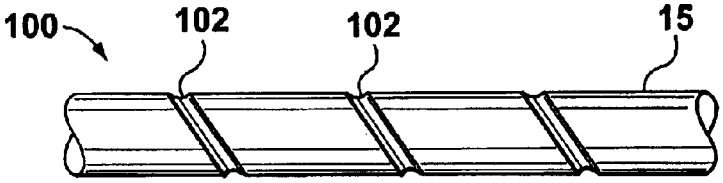
FIG. 18 is a side scrap view of yet a further configuration of a turbulizer of the heat exchanger of FIG. 1.
Figure 19:
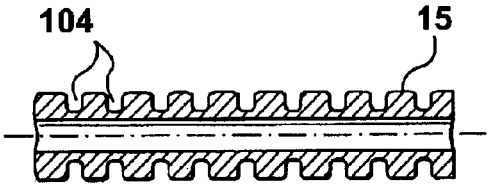
FIG. 19 is a sectional view of still a further configuration of a turbulizer of the heat exchanger of FIG. 1.

In place of outwardly extending flow augmentation means such as helical fin 82 or rings 92 or 98 on tube 15, in some embodiments inward perturbations could be used to distribute liquid phase fluid flow in manifold chamber 32C. For example, FIG. 18 shows a further possible turbulizer 100 for use in manifold chamber 32C, having a helical groove 102 provided about the outer surface of the intake tube 15 to break up and distribute liquid phase fluid flow, instead of a helical fin. In some embodiments, an alternating helical groove and helical fin could alternatively be used. In some embodiments, the helical groove could be replaced with a number of spaced apart annular grooves as shown in FIG. 19.

As will be apparent to those skilled in the art in light of the foregoing disclosure, many alterations and modifications are possible in the practice of this invention without departing from the spirit or scope thereof. The forgoing description is of the preferred embodiments and is by way of example only, and is not to limit the scope of the invention.

What is claimed is:

1. A heat exchanger comprising:

a manifold defining adjacent first and second manifold chamber sections that are in flow communication with each other through a manifold chamber section opening;

a first plurality of tube members each defining an internal flow channel, each of the internal flow channels defined by the first plurality of tube members having a flow channel opening communicating with the first manifold chamber section;

a second plurality of tube members each defining an internal flow channel, each of the internal flow channels defined by the second plurality of tube members having a flow channel opening communicating with the second manifold chamber section; and an elongate inlet tube fixed in the manifold for bringing fluid into the heat exchanger, having a portion that extends through the first manifold chamber section and through the manifold chamber section opening, the inlet tube including a turbulizing structure located along an outer surface of the inlet tube adjacent a plurality of the flow channel openings of the internal flow channels defined by the first plurality of tube members, the turbulizing structure having portions that are non-parallel to a longitudinal axis of the inlet tube for redirecting liquid phase fluid flowing adjacent the inlet tube in the first manifold chamber section among the first plurality of tube members.

2. The heat exchanger of claim 1 wherein the turbulizing structure includes a helical fin.

3. The heat exchanger of claim 2 wherein at least one of the size, pitch, and spacing between adjacent revolutions of the helical fin varies along a length of the inlet tube.

4. The heat exchanger of claim 2 wherein the helical fin extends outwardly from the inlet tube substantially transverse to a primary liquid flow direction of liquid through the first manifold chamber section.

5. The heat exchanger of claim 1 wherein the turbulizing structure includes a plurality of spaced apart annular rings projecting from an outer surface of the inlet tube.

6. The heat exchanger of claim 1 wherein the turbulizing structure includes a helical grove formed on an outer surface of the inlet tube.

7. The heat exchanger of claim 1 wherein the turbulizing structure includes a plurality of spaced apart annular grooves formed on an outer surface of the inlet tube.

8. The heat exchanger of claim 1 wherein the longitudinal axis of the inlet tube is substantially parallel to a primary liquid flow direction of a liquid entering the first manifold section through the manifold chamber opening.

9. The heat exchanger of claim 1 wherein the heat exchanger is a multi-pass heat exchanger and the portion of the inlet tube having the turbulizing structure is located only in the first manifold chamber section and the first manifold chamber section is associated with a final heat exchanger pass.

10. The heat exchanger of claim 1 wherein the heat exchanger is an evaporator.

11. The heat exchanger of claim 1 wherein each of the tube members is a plate pair formed of back-to-back plates defining the flow channel therebetween.

12. The heat exchanger of claim 1 wherein the first manifold chamber section includes a fluid flow area around the turbulizing structure and into which the annular rings do not extend, the fluid flow area communicating with the plurality of flow channel openings of the internal flow channels defined by the first plurality of tube members.

13. A heat exchanger comprising:

a first plurality of stacked tube members having respective first inlet and first outlet distal end portions defining respective first inlet and first outlet openings, all of said first inlet openings being joined together so that the first inlet distal end portions form a first inlet manifold chamber and all of said first outlet openings being joined together so that the first outlet distal end portions form a first outlet manifold chamber;

a second plurality of stacked tube members having respective second inlet and second outlet distal end portions defining respective second inlet and second outlet openings, all of said second openings being joined together so that the second inlet distal end portions form a second inlet manifold chamber and all of said second outlet openings being joined together so that the second outlet distal end portions form a second outlet manifold chamber;

the first inlet manifold chamber being joined to communicate with the second outlet manifold chamber through an annular opening; and a fixed inlet tube for bringing fluid to be evaporated into the heat exchanger, the inlet tube having a portion the extends through the first inlet manifold chamber and through the annular opening, the annular opening being larger than a portion of the inlet tube extending therethrough to permit fluid to flow from the second outlet manifold chamber to the first inlet manifold chamber through the annular opening external to the inlet tube, a helical fin being provided on the portion of the inlet tube in the first inlet manifold chamber to distribute among the first plurality of stacked tube members fluid flowing into the first inlet manifold chamber from the annular opening.

14. The heat exchanger of claim 13 wherein the helical fin includes a wire wrapped around and secured to the inlet tube.

15. The heat exchanger of claim 13 including a third plurality of stacked tube members having respective third inlet and third outlet distal end portions defining respective third inlet and third outlet openings, all of said third inlet openings being joined together so that the third inlet distal end portions form a third inlet manifold chamber and all of said third outlet openings being joined together so that the third outlet distal end portions form a third outlet manifold chamber;

the core pipe having an outlet end opening into the third inlet manifold chamber, the third, second and first plurality of stacked tube members being arranged to define a heat exchanger flow path for routing fluid entering the heat exchanger through the core pipe first though the third plurality of stacked tube members, subsequently through the second plurality of stacked tube members and then through the first plurality of stacked tube members.

16. The heat exchanger of claim 15 wherein the tube members have a U-shaped configuration.

17. A heat exchanger comprising:

a manifold defining an inlet manifold chamber having a manifold chamber inlet opening;

a plurality of tube members each defining an internal flow channel having a flow channel opening communicating with the manifold chamber; and an elongate core pipe fixed in the manifold chamber, the core pipe having a turbulizing structure extending along a portion thereof passing adjacent the flow channel openings for distributing liquid phase fluid flowing into the manifold chamber among the flow channels, the turbulizing structure including a plurality of spaced apart annular rings projecting from an outer surface of the core pipe.

18. The heat exchanger of claim 17 wherein the manifold chamber includes a fluid flow area around the turbulizing structure and into which the annular rings do not extend, the fluid flow area communicating with the plurality of flow channel openings.

19. The heat exchanger of claim 18 wherein the annular rings are secured to an outer surface of the core pipe.

20. The heat exchanger of claim 18 wherein the annular rings are formed from compressed sections of the core pipe.

21. A multi-pass heat exchanger with a plurality of heat exchanger sections each associated with a single heat exchanger pass and each having (a) a stack of tube members, and (b) manifold portions forming an inlet manifold chamber and an outlet manifold chamber, the tube members each defining respective flow channels communicating at opposite ends thereof with associated inlet and outlet manifold chambers, the heat exchanger including an inlet tube passing through a first one of the heat exchanger sections for carrying fluid to a further heat exchanger section, the inlet tube passing through an annular inlet opening that opens into the inlet manifold chamber of the first heat exchanger section, a turbulizing structure being provided along the inlet tube in the inlet manifold chamber of the first heat exchanger section for distributing liquid entering through the inlet opening among the tube member flow channels communicating with the inlet manifold chamber of the first heat exchanger section, the turbulizing structure including a plurality of spaced apart annular rings projecting from an outer surface of the inlet tube.

22. The heat exchanger of claim 21 wherein the annular rings are secured to an outer surface of the inlet pipe.

23. The heat exchanger of claim 21 wherein the annular rings are formed from compressed sections of the inlet pipe.

* * * * *